US007913440B2

(12) United States Patent
Murg et al.

(10) Patent No.: US 7,913,440 B2
(45) Date of Patent: Mar. 29, 2011

(54) TELESCOPIC SIGHT

(75) Inventors: Erwin Murg, Rum (AT); Ludwig Pernstich, Rum (AT)

(73) Assignee: Swarovski-Optik KG., Absam (AT)

( * ) Notice: Subject to any disclaimer, the term of this patent is extended or adjusted under 35 U.S.C. 154(b) by 998 days.

(21) Appl. No.: 11/797,595

(22) Filed: May 4, 2007

(65) Prior Publication Data

US 2008/0016748 A1 Jan. 24, 2008

(30) Foreign Application Priority Data

May 10, 2006 (AT) ..... A 803/2006

(51) Int. Cl.
*F41G 1/38* (2006.01)

(52) U.S. Cl. ..... 42/122

(58) Field of Classification Search ..... 42/119, 42/120, 121, 122, 123, 130, 131
See application file for complete search history.

(56) References Cited

U.S. PATENT DOCUMENTS

| | | | | |
|---|---|---|---|---|
| 2,997,916 | A | 8/1961 | Friedman et al. | |
| 4,643,542 | A * | 2/1987 | Gibson | 359/424 |
| 4,965,439 | A | 10/1990 | Moore | |
| 5,388,005 | A * | 2/1995 | Wilson | 359/694 |
| 6,005,711 | A | 12/1999 | Mai et al. | |
| 6,351,907 | B1 | 3/2002 | Otteman | |
| 6,516,551 | B2 * | 2/2003 | Gaber | 42/132 |
| 6,691,447 | B1 | 2/2004 | Otteman | |
| 6,721,095 | B2 * | 4/2004 | Huber | 359/427 |
| 7,458,180 | B2 * | 12/2008 | Liang | 42/123 |
| 2006/0254115 | A1 | 11/2006 | Thomas et al. | |

FOREIGN PATENT DOCUMENTS

| | | |
|---|---|---|
| DE | 199 40 118 | 3/2001 |
| EP | 0 153 740 | 9/1985 |
| WO | 2006/060489 | 6/2006 |

OTHER PUBLICATIONS

European Search Report issued Dec. 22, 2010 in corresponding European Application No. 07 00 6781.

* cited by examiner

*Primary Examiner* — Troy Chambers
(74) *Attorney, Agent, or Firm* — Wenderoth, Lind & Ponack, L.L.P.

(57) ABSTRACT

A telescopic sight includes at least one main tube and a reticule with a reticule adjusting device arranged on the main tube for adjusting the reticule and an optical focusing means with a focus adjusting device arranged on the main tube for focusing the optical focusing means, characterised in that the reticule adjusting device and the focus adjusting device are arranged in the form of an integrated adjusting device, preferably in the form of an integrated adjusting turret, jointly on the main tube.

17 Claims, 2 Drawing Sheets

TELESCOPIC SIGHT

BACKGROUND OF THE INVENTION

I. Field of the Invention

The invention relates to a telescopic sight comprising at least one main tube and a reticule with a reticule adjusting device arranged on the main tube for adjusting the reticule and an optical focusing means with a focus adjusting device arranged on the main tube for focusing the optical focusing means.

Particularly in the case of telescopic sights with a high degree of magnification the optical focusing means must be set or focused to the target distance in order to achieve a sharp image. A further reason for a suitable optical focusing means is avoiding a spacing between the image of the target produced by the objective lens and the reticule as such a spacing would result in parallax and thus an aiming error. In addition at least any relatively high-grade telescopic sight requires a reticule adjusting device for adjusting the reticule.

II. Description of the Related Art

It is known in the state of the art to use objective lens-side adjusting rings as the focus adjusting device. In addition, however, there are also telescopic sights in which a total of three adjusting turrets are provided in the region of the central tube. Two of those adjusting turrets serve as the reticule adjusting device. The third adjusting turret serves as the focus adjusting device.

The objective lens-side adjusting ring as the focus adjusting device is relatively unwieldy to operate. In addition, it involves a large diameter for the telescopic sight in the objective lens region, and thus involves a correspondingly high weight. In addition, relatively high mounting on the rifle is necessary.

The consequence of the above-mentioned variant having the three adjusting turrets is that at least the two laterally disposed adjusting turrets are each only simple to operate with one hand. In addition, that variant represents a large amount of space occupied on the telescopic sight. That causes problems in particular when still further adjusting functions, such as, for example, controlling the brightness of the reticule illumination, are to be provided. A further disadvantage of this variant is that the distance set at the optical focusing means cannot be read off in alignment with the telescopic sight axis. Overall the variant with the three adjusting turrets means that the telescopic sight is of an irregular overall appearance. A further disadvantage is that the additional focusing device is a nuisance when bearing the weapon.

SUMMARY OF THE INVENTION

It is an object of the invention to improve a telescopic sight of the general kind set forth in such a way that the stated disadvantages of the state of the art are avoided.

That is achieved in that the reticule adjusting device and the focus adjusting device are arranged in the form of an integrated adjusting device, preferably in the form of a integrated adjusting turret, jointly on the main tube.

It is therefore provided that the integrated adjusting device includes both the reticule adjusting device and also the focus adjusting device. That integrated configuration for the reticule adjusting device and the focus adjusting device provides additional space for at least one further operating function. Furthermore, the invention can be designed to be of a relatively low structure whereby obstructions to the view beyond the telescopic sight are substantially avoided. With a suitable design the dimensions of the integrated adjusting device are not substantially larger than those of usual reticule adjusting devices. The smaller number of adjusting devices to be viewed from the exterior results in an overall more unobtrusive appearance for the telescopic sight.

The term main tube relates generally to the housing of the telescopic sight. It can therefore be of any desired external shape, such as, for example, of a round, oval, rectangular or differently shaped, internal and/or external cross-section.

Desirably the integrated adjusting device is arranged at the top on the main tube in the operative position of the telescopic sight, whereby simple operation is possible with the right hand and the left hand. In addition that also makes it possible to easily read off the set distance as the integrated adjusting device and the scales mounted externally thereon are in alignment with the axis of the telescopic sight. In particular the scales for the aiming line and the distance can be arranged directly one above the other and can thus be arranged in such a way that they can be conveniently read off at the same time.

A further advantage of an integrated adjusting device is that, with a coupleable configuration in respect of the reticule adjusting device and the focus adjusting device, automatic ballistic correction is possible at least within certain ranges.

In a preferred embodiment it is provided that the reticule adjusting device which is included in the integrated adjusting device serves for height adjustment of the reticule. The reticule adjusting device for lateral adjustment of the reticule can then, for example, be in the form of a separate adjusting device or a separate adjusting turret. It is however, also possible for lateral adjustment to be also additionally incorporated into the integrated adjusting device, or for the height adjustment to be in the form of a separate adjusting turret, and for lateral adjustment to be implemented by means of the integrated adjusting device.

BRIEF DESCRIPTION OF THE DRAWINGS

Further features and details of the invention will be apparent from the specific description hereinafter. In the drawings.

DETAILED DESCRIPTION OF THE DRAWINGS

Figure 1:
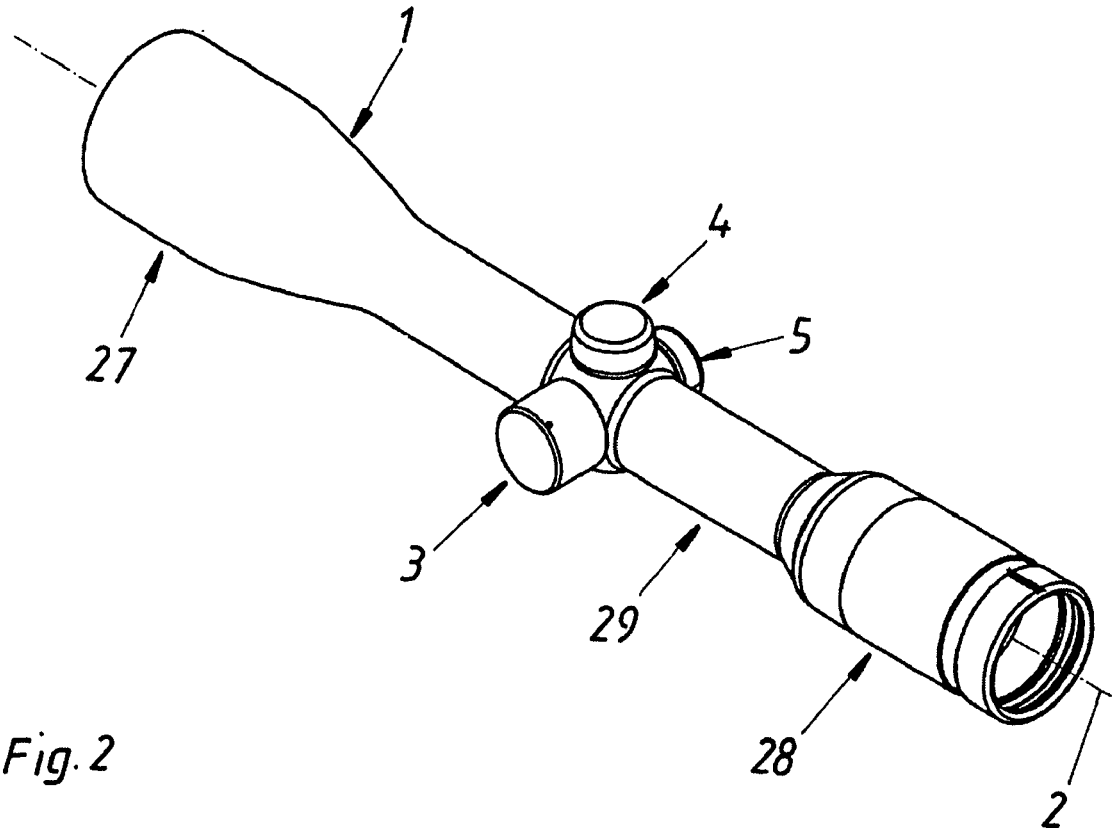
FIG. 1 shows a telescopic sight according to the state of the art with three adjusting turrets.
Figure 2:
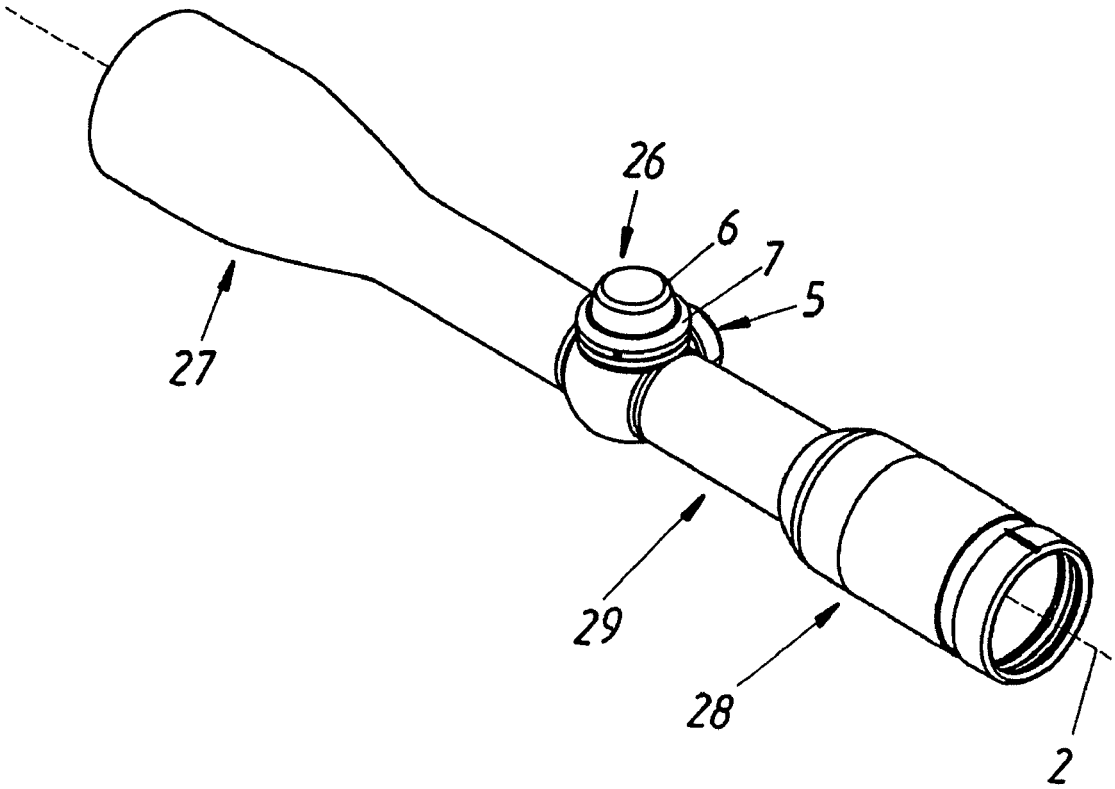
FIG. 2 shows an embodiment according to the invention of a telescopic sight.

Both the telescopic sight shown in FIG. 1 in accordance with the state of the art and also the embodiment according to the invention as shown in FIG. 2 have a main tube 1 of a diameter which is enlarged in the objective lens region 27 and in the eyepiece region 28. The central tube 29 of the main tube 1 is arranged between those regions. It is of a smaller diameter in comparison with the regions 27 and 28. The central tube 29 in both telescopic sights carries the adjusting devices which here are in the form of adjusting turrets.

The known telescopic sight shown in FIG. 1 has three adjusting devices in the form of the adjusting turrets 3, 4 and 5. This involves the focus adjusting device 3 as well as the height adjustment 4 and the lateral adjustment 5 as reticule adjusting devices.

In the embodiment according to the invention as shown in FIG. 2 the focus adjusting device 3 and the reticule adjusting device for height adjustment 4 are in the form of an integrated adjusting device 26. As a manually actuable rotatable actuating element, in this arrangement the rotary knob 6 is provided for height adjustment 4 and the rotary ring 7 surrounding the rotary knob 6 is provided for the focus adjusting device.

Figure 3:
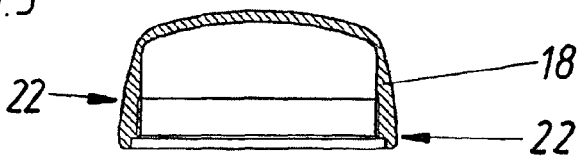
FIG. 3 shows a view in vertical section in the longitudinal direction through the main tube of the embodiment according to the invention as shown in FIG. 2 in the region of the integrated adjusting device.
Figure 3:
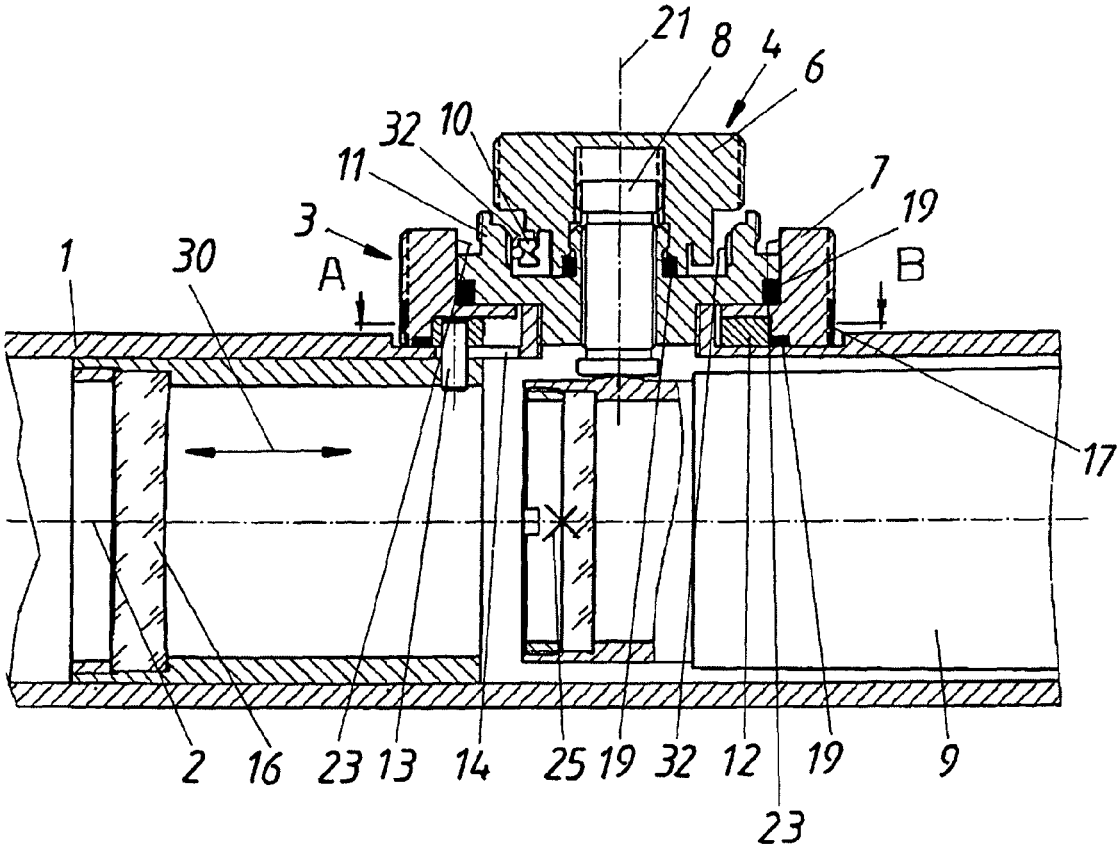
Figure 4:
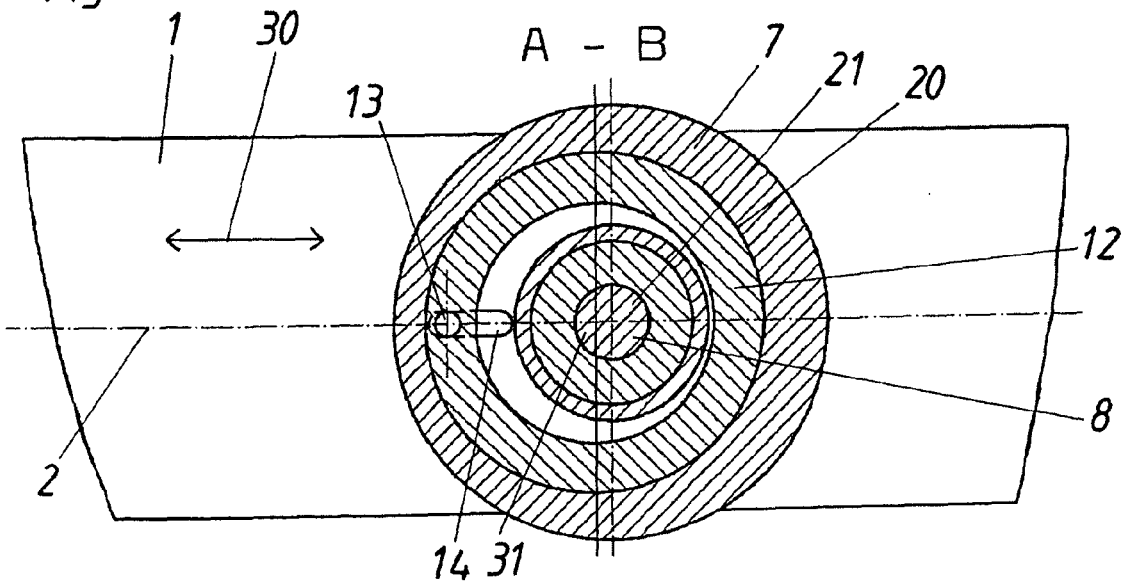
FIG. 4 shows a horizontal section taken along the straight line AB in FIG. 3.

FIG. 3 shows a vertical section through the integrated adjusting device 26 along the optical axis 2. Both the rotary ring 7 and also the rotary knob 6 are carried by a common housing 11. The latter is fixed non-rotatably to the outer tube 1. The rotary knob 6 for height adjustment 4 engages by way of latching means 10, preferably permanently, into a corresponding latching groove 32 on the housing 11. Rotation of the rotary knob 6 moves the spindle 8 which is mounted therein and which is fixedly connected to the rotary knob and which is screwed in and out in a vertical direction 24 by a rotational movement. The spindle 8 bears with its lower end against the housing 9 of a per se known reversal system. The reticule 25 is in turn integrated thereinto. Height adjustment of the reticule 25 is thus effected by screwing the spindle 8 in and out. As can be seen particularly clearly from FIG. 4 the rotary ring 7 arranged coaxially with the rotary knob 6 has an inner recess 20 which is arranged eccentrically with respect to the axis of rotation 21 and in which there is arranged an inner ring 12 which is mounted eccentrically thereby. An entrainment pin 13 is in turn fixed to the ring 12 and is compulsorily guided in a longitudinal groove 14 of the main tube 1. The entrainment pin 13 is in turn fixedly connected to the optical focusing means holder 15 which is supported displaceably in the interior of the main tube 1 in the directions 30 in parallel relationship with the optical axis 2 of the telescopic sight. The optical focusing means holder 15 carries the optical focusing means 16 which here is in the form of an individual lens.

This arrangement ensures that, upon rotation of the rotary ring 7, the axis of symmetry 31 of the inner ring 12 is displaced in one of the directions 30. That provides in a condition of compulsory guidance a corresponding displacement of the entrainment pin 13 within the longitudinal groove 14 and thus displacement of the optical focusing means 16 within the main tube 1 along the optical axis 2 whereby the telescopic sight can be focused. Arranged externally on the rotary ring 7 in the illustrated embodiment is a distance scale 17 showing the set distance. In the illustrated embodiment the maximum possible rotary angle of the rotary ring 7 is limited to <180° by virtue of the longitudinal groove 14 being of a corresponding length. The rotary angle however can also be 360° or any other angle. The abutment is to be suitably designed in each case. In principle the rotary angle limitation is optional.

Both the rotary knob 6 and also the rotary ring 7 are sealed off in relation to the housing 11 and thus in relation to main tube 1 by way of seals 19.

A cap 18 is provided as an attachment on the rotary knob 6 in this embodiment. The cap 18 can be screwed to the housing 11 in order to prevent unintentional adjustment of the rotary knob 6, and thus the reticule adjusting device. In a preferred embodiment, however, it can also be provided that the cap 18 serves for coupling the reticule adjusting device 4 to the focus adjusting device 3 for automatic distance-dependent ballistic correction. In this case the cap 18 can be moved into two limit positions spaced from each other in a vertical direction 24 on the rotary knob 6. In the lower limit position, the tooth arrangement 22 provided externally on the cap 18 engages into a corresponding internal tooth arrangement 23 on the rotary ring 7. The reticule adjusting device 4 and the focus adjusting device 3 are coupled together in that position. In the upper limit position of the cap 18, it is then provided that the tooth arrangements 22 and 23 no longer engaged into each other whereby the reticule adjusting device 4 and the focus adjusting device 3 are uncoupled, and are thus operable independently of each other. For example, that uncoupling is also appropriate for basic adjustment or adaptation of the telescopic sight to the weapon. In the coupled condition an overall relatively large gripping surface is afforded by way of the cap 18 and the ring 17 for manual operation and automatic distance-dependent ballistic correction.

The invention claimed is:

1. A telescopic sight comprising:

a main tube;

a reticule;

a reticule adjusting device arranged on the main tube for adjusting the reticule;

an optical focusing device and a focus adjusting device arranged on the main tube for focusing the optical focusing device, wherein the reticule adjusting device and the focus adjusting device are arranged so as to jointly form of an integrated adjusting device on the main tube.

2. The telescopic sight according to claim 1, wherein the integrated adjusting device is an integrated adjusting turret.

3. The telescopic sight according to claim 1, wherein at least one of the devices selected from the group consisting of the reticule adjusting device and the focus adjusting device has a rotatable or pivotable actuating element.

4. The telescopic sight according to claim 3, wherein the rotatable or pivotable actuating element is configured to be actuatable by hand.

5. The telescopic sight according to claim 3, wherein each of the reticule adjusting device and the focus adjusting device has a rotatable or pivotable actuating element, and the rotatable or pivotable actuating element of the reticule adjusting device is arranged substantially coaxially with the rotatable or pivotable actuating element of the focus adjusting device.

6. The telescopic sight according to claim 3, wherein the rotatable or pivotable actuating element is a rotary knob or a rotary ring.

7. The telescopic sight according to claim 3, wherein each of the reticule adjusting device and the focus adjusting device has a rotatable or pivotable actuating element, and the rotatable or pivotable actuating element of the reticule adjusting device is a rotary knob and the rotatable or pivotable actuating element of the focus adjusting device is a rotary ring.

8. The telescopic sight according to claim 7, wherein the rotary ring surrounds the rotary knob.

9. The telescopic sight according to claim 7, wherein the reticule adjusting device for adjusting the reticule has a spindle which is axially displaceable by rotation.

10. The telescopic sight according to claim 7, wherein the focus adjusting device has an inner ring mounted eccentrically in the rotary ring for converting a rotary movement into a linear movement.

11. The telescopic sight according to claim 1, wherein the reticule adjusting device is configured for at least one adjustment selected from a group consisting of a height adjustment and a lateral adjustment of the reticule.

12. The telescopic sight according to claim 1, wherein the reticule adjusting device and the focus adjusting device are capable of being coupled for automatic ballistic correction.

13. The telescopic sight according to claim 1, wherein the main tube has a central tube arranged between an objective lens region and an eyepiece region and the integrated adjusting device is arranged in the region of the central tube.

14. The telescopic sight according to claim 13, wherein at least one region selected from a group consisting of an objective lens region of the main tube and an eyepiece region of the main tube has a larger diameter than the central tube.

15. The telescopic sight according to claim 1, wherein the integrated adjusting device is arranged on the top on the main tube in an operative position of the telescopic sight.

16. The telescopic sight according to claim 1, wherein the reticule is integrated into a reversal system of the telescopic sight.

17. The telescopic sight according to claim 1, wherein the reticule adjusting device and the focus adjusting device are arranged in a combined adjusting device which is fixed on the main tube.

* * * * *